US008231303B1

(12) United States Patent
Bowen et al.

(10) Patent No.: US 8,231,303 B1
(45) Date of Patent: Jul. 31, 2012

(54) ROAD SPIKES WITH IMPROVED CHARACTERISTICS AND METHODS OF DEPLOYMENT

(75) Inventors: Stephen T. Bowen, LaCrescent, MN (US); Larry E. Tiedemann, Winona, MN (US); Eric Jay Wollan, Winona, MN (US); Raj Narain Mathur, Goodview, MN (US)

(73) Assignee: Plasticomp, Inc., Winona, MN (US)

( * ) Notice: Subject to any disclaimer, the term of this patent is extended or adjusted under 35 U.S.C. 154(b) by 256 days.

(21) Appl. No.: 12/548,666

(22) Filed: Aug. 27, 2009

(51) Int. Cl.
*E01C 13/12* (2006.01)

(52) U.S. Cl. ..... 404/6

(58) Field of Classification Search . 404/6; *E01C 13/12*
See application file for complete search history.

(56) References Cited

U.S. PATENT DOCUMENTS

| | | | | |
|---|---|---|---|---|
| 1,232,575 | A * | 7/1917 | Lefort | 256/2 |
| 1,721,978 | A * | 7/1929 | Sherwood | 256/1 |
| 2,346,713 | A | 4/1944 | Walker | |
| 2,912,229 | A | 10/1959 | Persgard | |
| 5,123,774 | A * | 6/1992 | Dubiel | 404/6 |
| 5,328,292 | A | 7/1994 | Williams | |
| 5,330,285 | A * | 7/1994 | Greves et al. | 404/6 |
| 5,921,703 | A | 7/1999 | Becker et al. | |
| 5,921,704 | A * | 7/1999 | Pacholok et al. | 404/6 |
| 6,258,453 | B1 * | 7/2001 | Montsinger | 428/298.1 |
| 6,312,189 | B1 | 11/2001 | Marphetia | |
| 6,357,961 | B1 | 3/2002 | Marphetia | |
| 7,025,526 | B2 * | 4/2006 | Blair | 404/6 |
| 7,186,052 | B2 * | 3/2007 | Rom | 404/6 |
| 7,946,785 | B2 * | 5/2011 | Grosch | 404/6 |

FOREIGN PATENT DOCUMENTS

| | | |
|---|---|---|
| CH | 687 882 | * 3/1997 |
| GB | 2 300 247 | * 10/1996 |

* cited by examiner

*Primary Examiner* — Gary S Hartmann
(74) *Attorney, Agent, or Firm* — Brannen Law Office, LLC

(57) ABSTRACT

The present invention relates to road spikes that can made of long fiber reinforced thermoplastics that, when deployed, are geometrically positioned to puncture or disable a tire. The spikes can be formed of a long fiber reinforced thermoplastic containing 10-70% long fibers by weight. Spikes of this material can be made as direct and/or alternative replacements for existing metal spikes or as unique integrated devices. One integrated component is a device having several piercing elements that are deployed in a vertically divergent manner spaced about a vertical axis wherein at least one piercing element is directed towards the direction of the oncoming vehicle. In one embodiment deployable from a string, this is accomplished through the use of spikes with six piercing elements that are self-leveling and self-centering. In another embodiment, several clusters can be fixed to a tube that is foldable and extendable.

5 Claims, 17 Drawing Sheets

ROAD SPIKES WITH IMPROVED CHARACTERISTICS AND METHODS OF DEPLOYMENT

BACKGROUND OF THE INVENTION

1. Field of the Invention

The present invention relates to road spikes with improved characteristics and methods of deployment, and in particular to road spikes made of long fiber reinforced thermoplastics that, when deployed, are geometrically positioned to puncture or disable a tire.

2. Description of the Related Art

The problems associated with stopping the escape of a vehicle in police and military applications are well known. It is desirable to cause rapid stopping of the vehicle by puncturing one or more tires, and then allowing the air to escape without plugging the hole. There are numerous devices that are designed to accomplish these tasks. Some examples are:

U.S. Pat. No. 2,346,713 to Walker is titled Caltrop. This patent teaches a body having four hollow arms equally spaced about a body. When three of the arms are in contact with a horizontal surface, the fourth arm is vertically oriented.

U.S. Pat. No. 2,912,229 to Persgard is titled Vehicle Impeding Device. This patent illustrates the use of spikes that are releasably received within a base, and as such, can be picked up by a tire.

U.S. Pat. No. 5,328,292 to Williams is titled Traffic Barrier Chain. This patent shows a barrier chain having splines, wherein ½ of the splines face the direction of the traffic flow at an angle of 45 degrees. The splines, however, do not appear to be removable from the chain. Also, any deviation from having the chain deployed perpendicular to the flow of traffic will result in deviation from the illustrated puncture angle.

U.S. Pat. No. 5,921,703 to Becker et al. is titled Caltrop. This patent illustrates a rigid caltrop structure that is formed from two metallic members which abut each other and are welded together. Pairs of adjacent corners of sides of triangular portions create penetration points. When three of the penetration points rest on a horizontal surface, the fourth penetration point projects upwards. The angle of penetration point projection is dependent upon the rotational angle of the caltrop relative the road surface.

U.S. Pat. No. 6,312,189 to Marphetia is titled Vehicle Tire Puncturing and Deflating Spike and Assembly Therefor. This patent shows a configuration of a metal spike.

U.S. Pat. No. 7,210,875 to Christle et al. is titled Entrapment Snare for the Termination of Vehicle Pursuits. This patent illustrates the use of two small but heavy weights connected by a flexible cable covered with spikes. FIG. 12 of this patent illustrates a spike design wherein all of the spikes are within a singular plane. Also, the spikes do not appear to be removable from the chain.

None of the existing products, including those illustrated in the above-mentioned patents teach, show or suggest spike assembly containing multiple spikes that can be removably attached to a deployment string.

Further, it is the industry standard to use metal spikes. This is because plastic is regarded as either too brittle (subject to shatter) or too flexible (incapable of puncture) to be used as road spikes. Yet metal spikes can be expensive, heavy and may require corrosion prevention protection. Hence, an engineered solution using plastics is desirable, both as replacement spikes in existing systems and as integrated devices.

Still further, none of the existing products, including those illustrated in the above-mentioned patents teach, show or suggest a configuration aligns at least one spike angled vertically divergent towards oncoming traffic regardless of device rotational orientation.

Related, none of the existing products, including those illustrated in the above-mentioned patents teach, show or suggest a six point configuration wherein the device is automatically self-leveling and self-centering on three spikes and having three remaining spikes project upwards with at least one spike being angled vertically divergent towards oncoming traffic regardless of the device rotational orientation.

Thus, there exists a need for road spikes with improved characteristics that solves these and other problems.

SUMMARY OF THE INVENTION

The present invention relates to road spikes with improved characteristics and methods of deployment, and in particular to road spikes made of long fiber reinforced thermoplastics that, when deployed, are geometrically positioned to puncture or disable a tire. The spikes can be formed of a long fiber reinforced thermoplastic containing 10-70% long fibers by weight. Spikes of this material can be made as direct and/or alternative replacements for existing metal spikes or as unique integrated devices. One integrated component is a device having several piercing elements that are deployed in a vertically divergent manner spaced about a vertical axis wherein at least one piercing element is directed towards the direction of the oncoming vehicle. The device can be configured to deploy from a carrier strip or a flexible string. In one embodiment deployable from a string, this is accomplished through the use of spikes with six piercing elements that are self-leveling and self-centering.

According to one advantage of the present invention, spikes made of long fiber reinforced thermoplastic can be provided. Advantageously, the spike can be comprised of approximately 10-70% long fiber by weight, wherein the fibers can be chopped to discontinuous lengths of fiber. The long fiber reinforced thermoplastic is strong and stiff to ensure piercing, and tough to prevent shattering. Further, long fiber reinforced thermoplastic is light weight, cost-effective, recyclable, reusable and does not require corrosion prevention measures. Spikes of this material can be made specifically as replacement spikes in existing systems, or can be incorporated into novel integrated configurations.

According to another advantage of the present invention, a device can be provided wherein at least one spike is angled vertically divergent towards oncoming traffic regardless of device rotational orientation. This can be accomplished in one embodiment wherein three or more piercing elements are oriented in vertically divergent positions and spaced about a vertical axis, and a base is removable held in a carrier strip. This is accomplished in another embodiment with a six point configuration wherein the device is automatically self-centering and self-leveling on three spikes and has the three remaining spikes project upwards with at least one spike being angled vertically divergent towards oncoming traffic regardless of the device rotational orientation.

According to a further advantage of one embodiment of the present invention, the device can be designed to break free from a chain upon impaling of a tire.

According to a still further advantage yet of the present invention, the device can be an integrated device.

According to a still further advantage of the present invention, a string with multiple devices is both easily storable in a compact manner and easy deployable across a relatively wide section of road. Related, successful deployment can be accomplished from a moving vehicle without the need for precision, due to the self-centering and self-leveling configuration and the ability to be properly angularly aligned relative the target vehicle regardless of angular orientation.

Other advantages, benefits, and features of the present invention will become apparent to those skilled in the art upon reading the detailed description of the invention and studying the drawings.

DETAILED DESCRIPTION OF THE PREFERRED EMBODIMENTS

While the invention will be described in connection with several preferred embodiments, it will be understood that it is not intended to limit the invention to those embodiments. On the contrary, it is intended to cover all alternatives, modifications and equivalents as may be included within the spirit and scope of the invention as defined by the appended claims.

Figure 7:
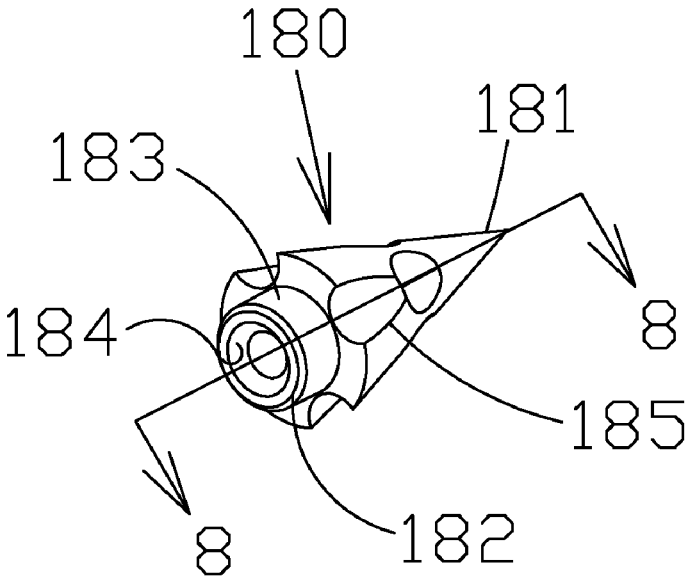
FIG. 7 is a perspective view showing a preferred embodiment of a spike.
Figure 8:
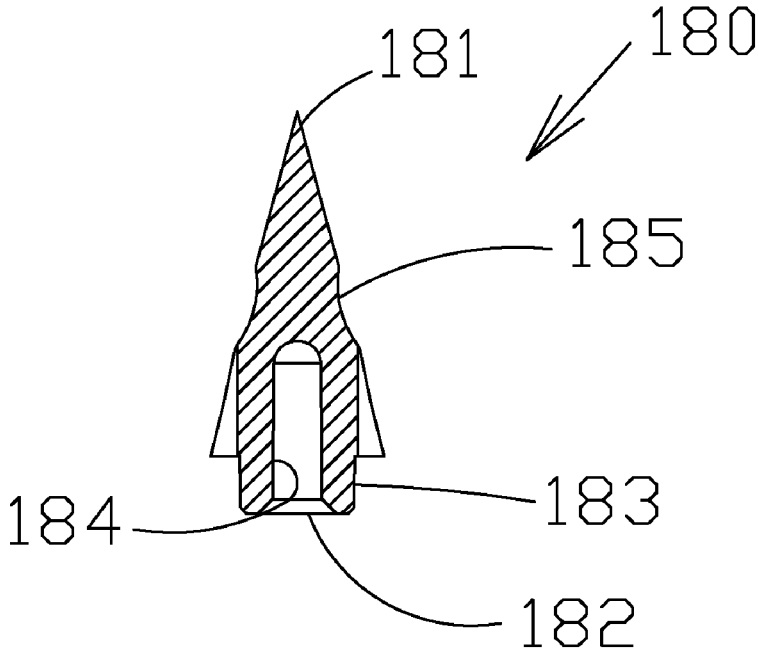
FIG. 8 is a cross-sectional view taken along line 8-8 in FIG. 7
Figure 9:
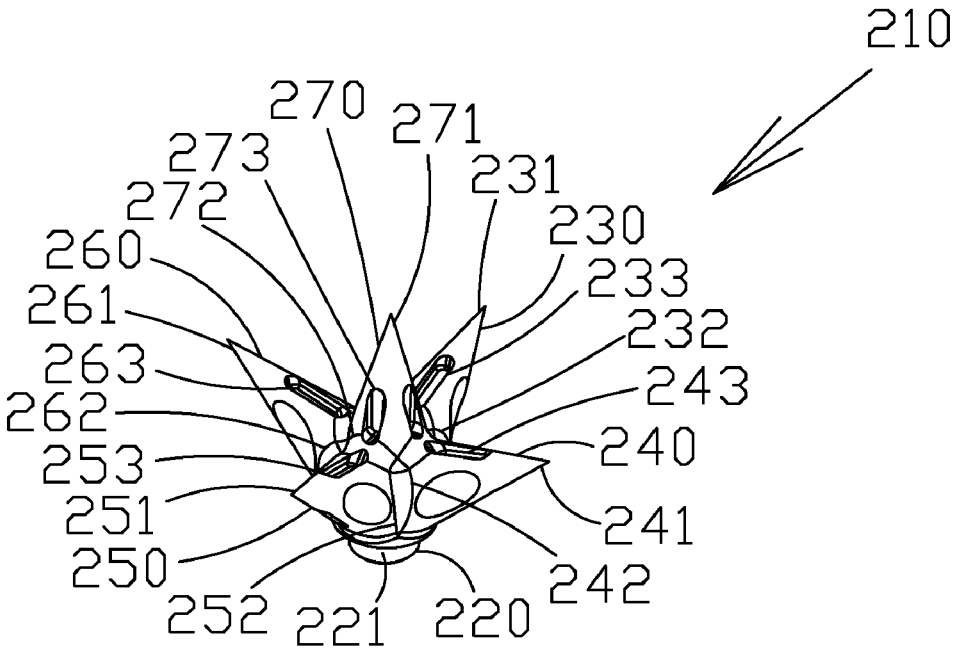
FIG. 9 is a perspective view of an alternative preferred embodiment of the present invention.
Figure 10:
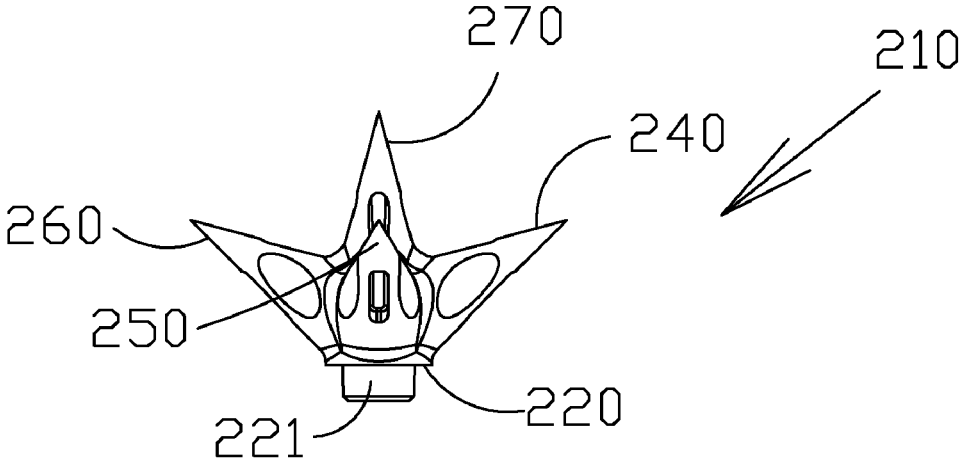
FIG. 10 is a side view of the alternative preferred embodiment of the present invention shown in FIG. 9.
Figure 11:
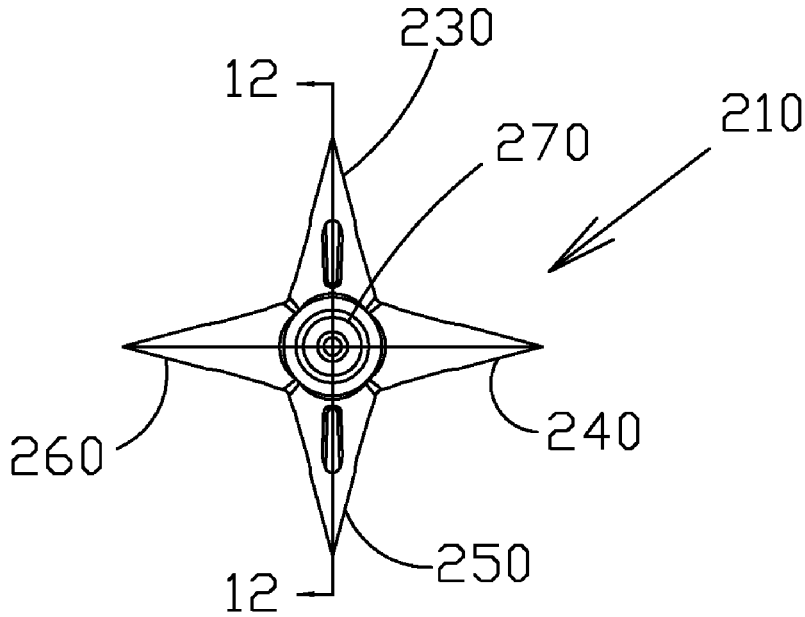
FIG. 11 is a top view of the alternative preferred embodiment of the present invention shown in FIG. 9.
Figure 12:
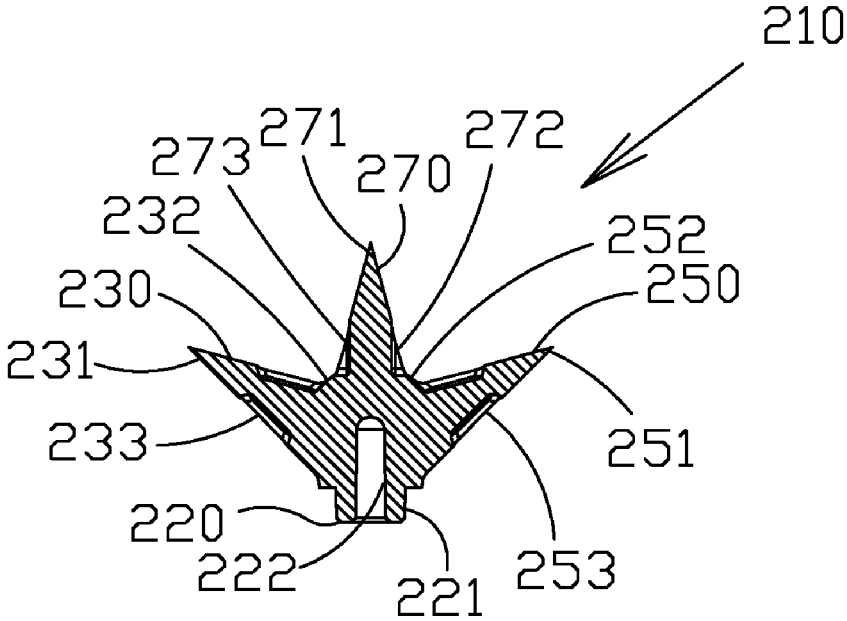
FIG. 12 is a cross-sectional view taken along line 12-12 in FIG. 11.
Figure 13:
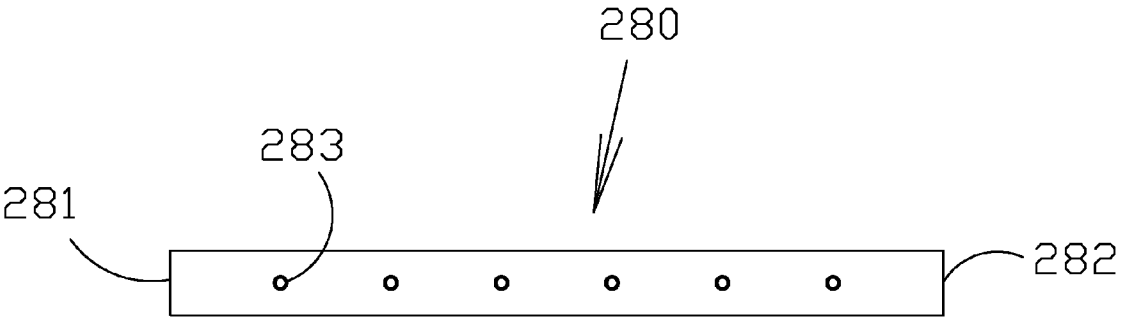
FIG. 13 is a top view of one embodiment of a carrier strip.
Figure 14:
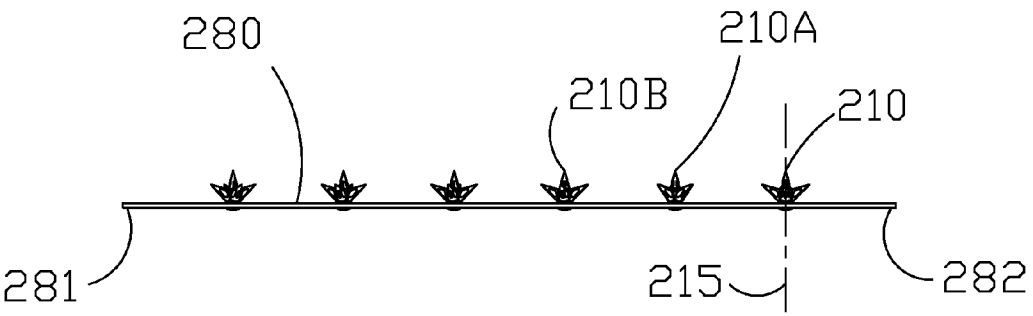
FIG. 14 is a side view showing several devices attached to the carrier strip illustrated in FIG. 13.
Figure 15:
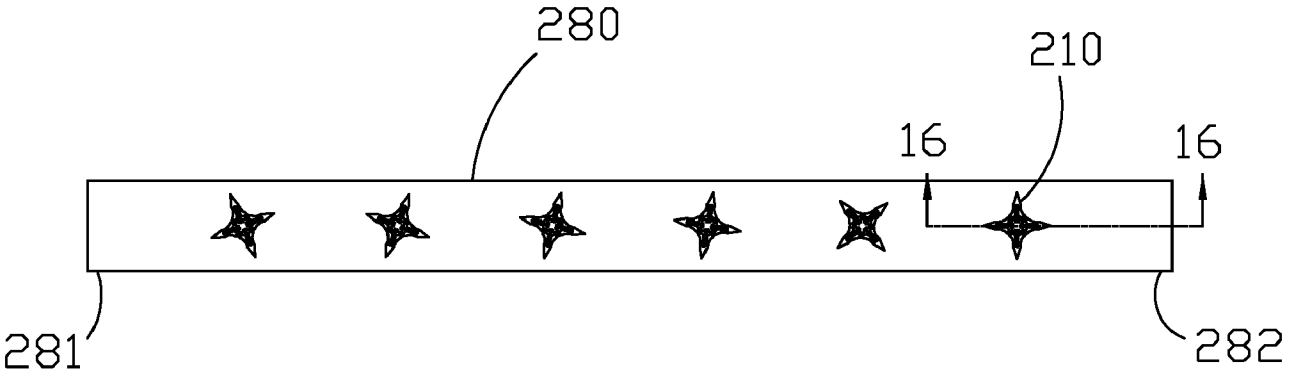
FIG. 15 is a top view of FIG. 14.
Figure 16:
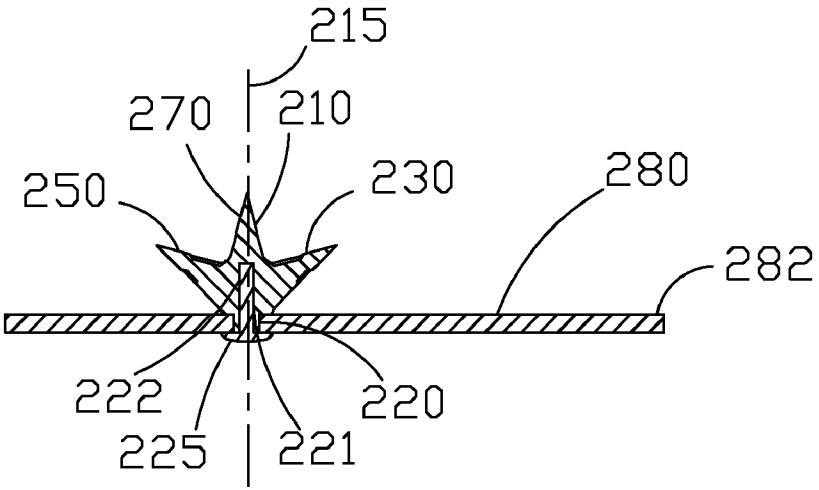
FIG. 16 is a cross-sectional view taken along line 16-16 in FIG. 15.
Figure 17:
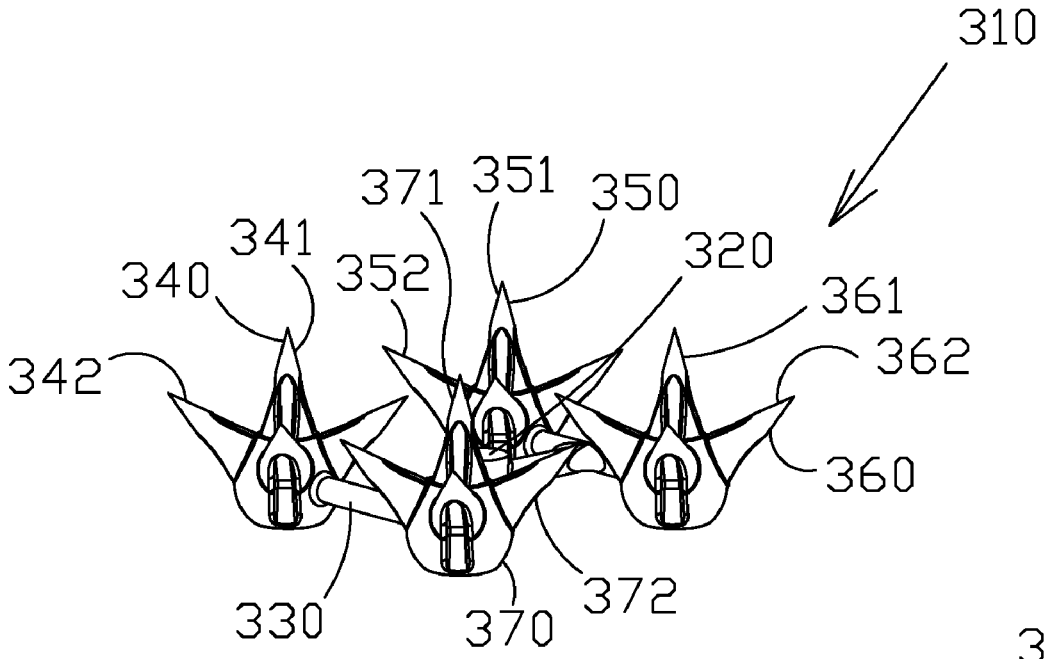
FIG. 17 is a perspective view of an alternative preferred embodiment of the present invention.
Figure 18:
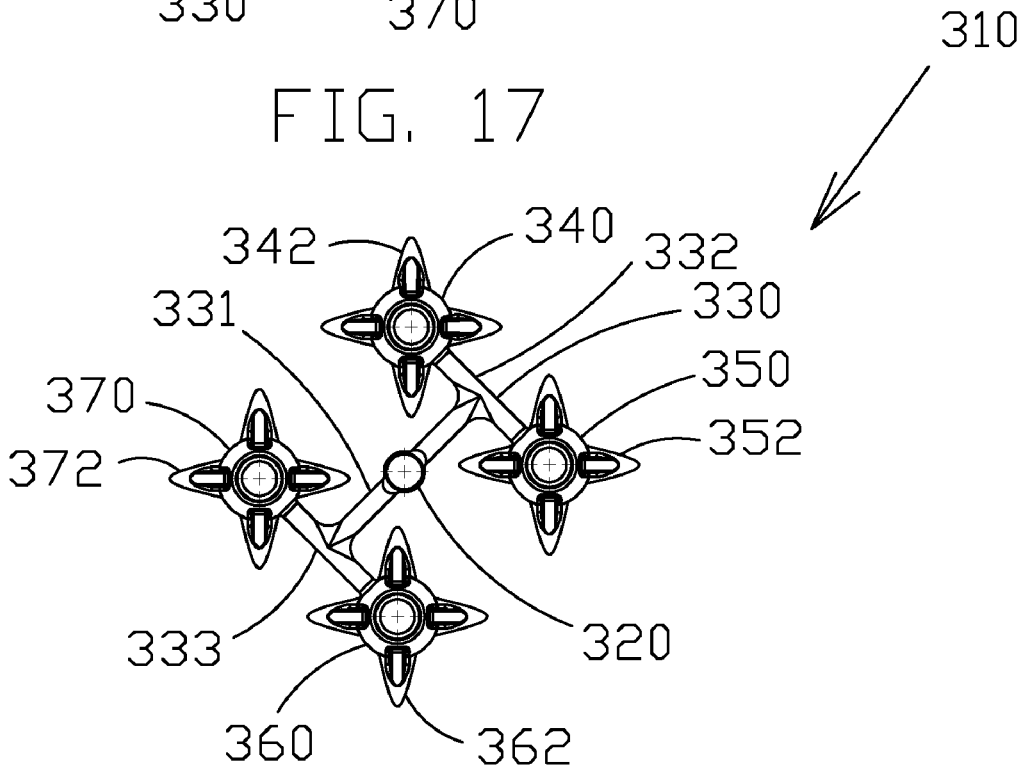
FIG. 18 is a bottom view of the alternative preferred embodiment shown in FIG. 17.
Figure 19:
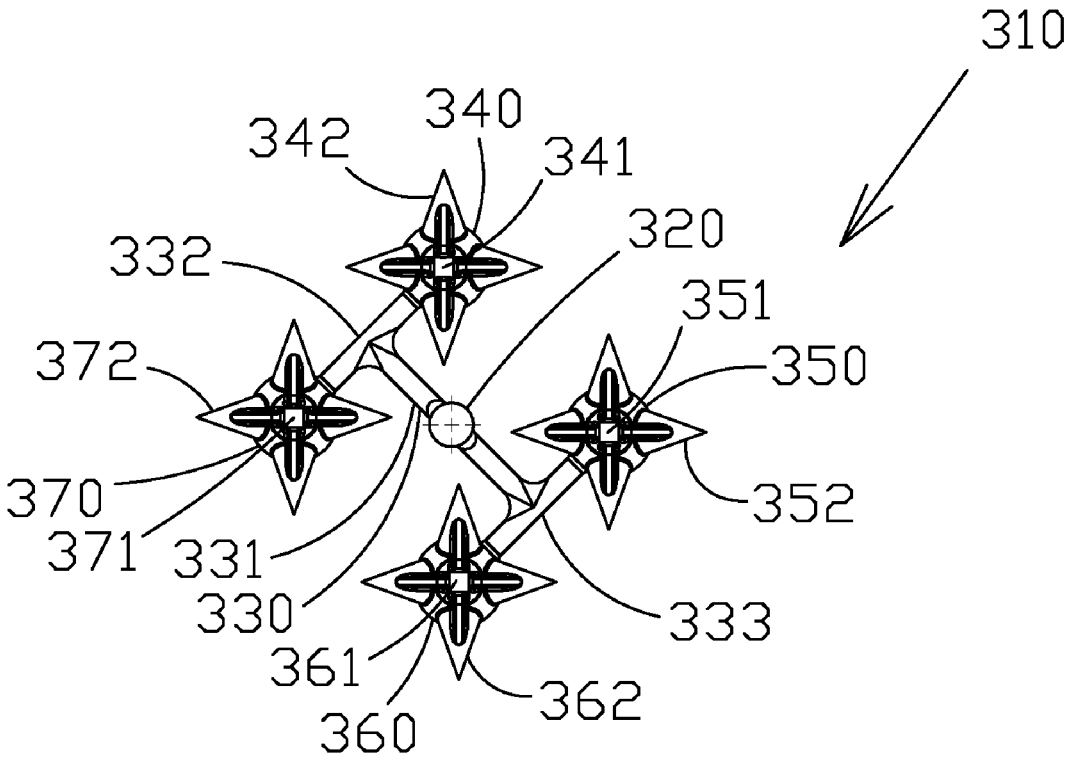
FIG. 19 is a top view of the alternative preferred embodiment shown in FIG. 17.
Figure 20:
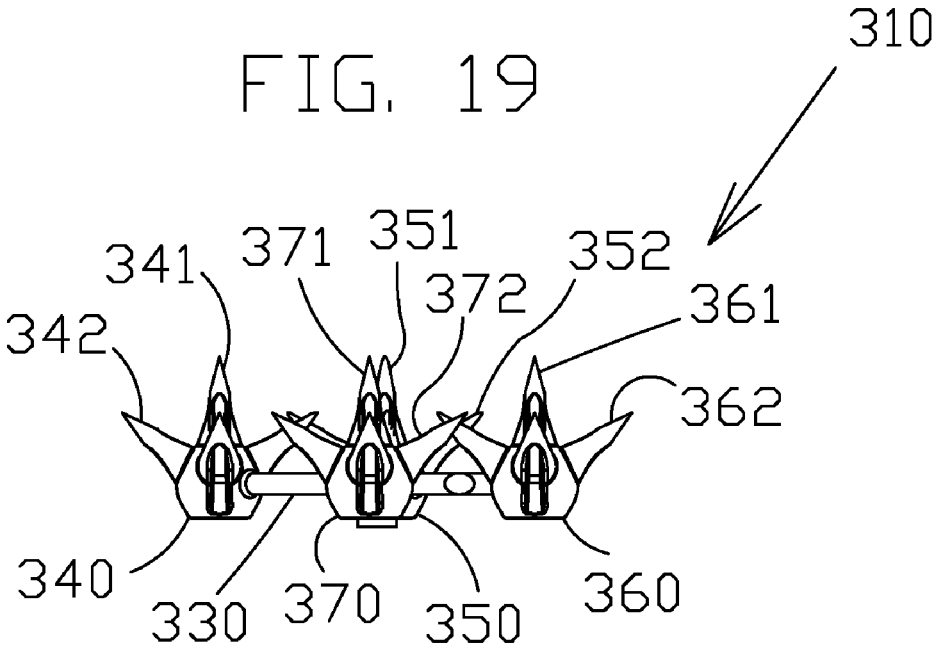
FIG. 20 is a side view of the alternative preferred embodiment shown in FIG. 17.
Figure 21:
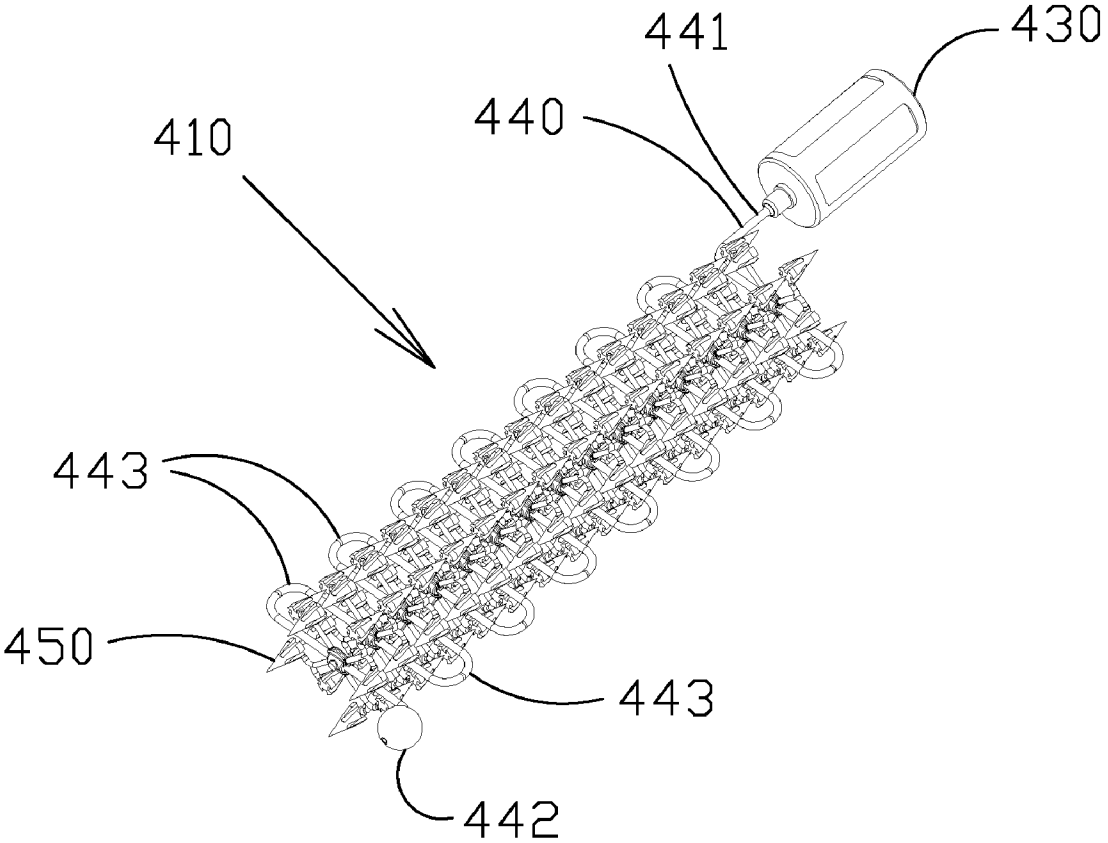
FIG. 21 is a perspective view of an alternative embodiment shown in a folded position.
Figure 22:
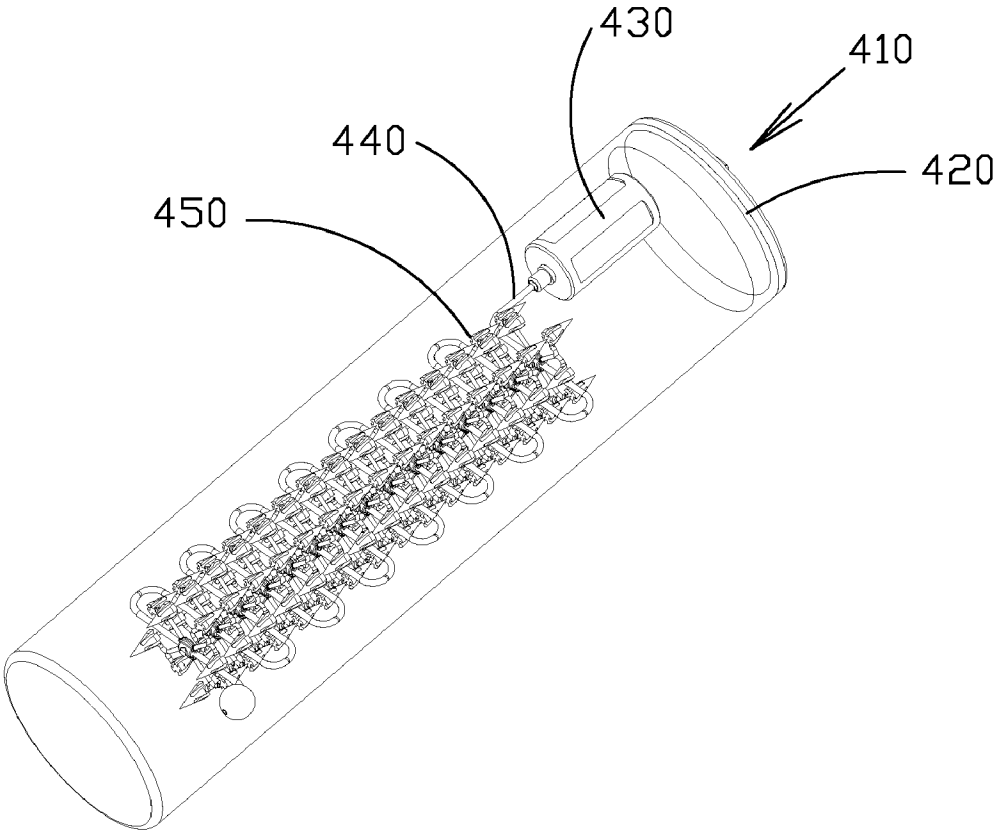
FIG. 22 is a perspective view of the alternative embodiment shown in FIG. 21, but in a storage container.
Figure 23:
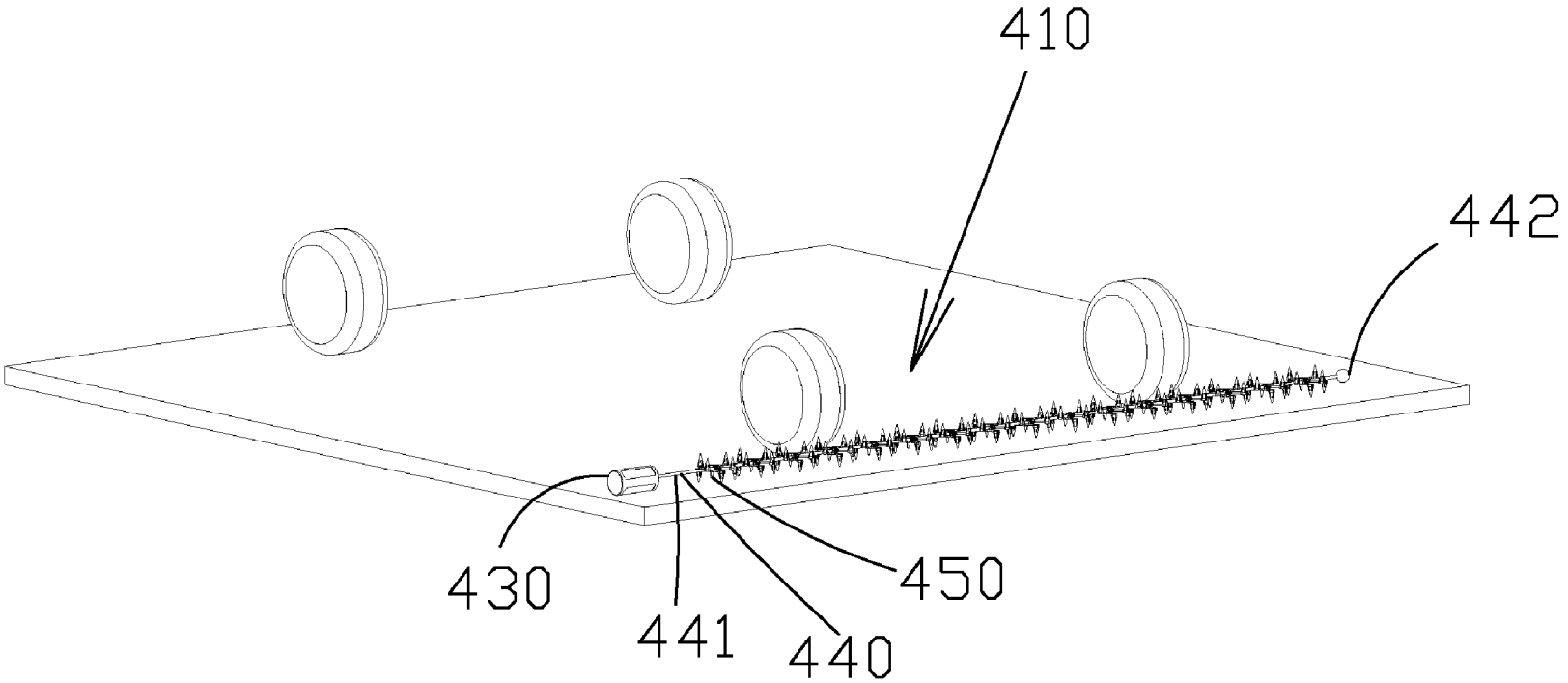
FIG. 23 is a perspective view of the alternative embodiment shown in FIG. 21 shown in a straight deployed orientation.
Figure 24:
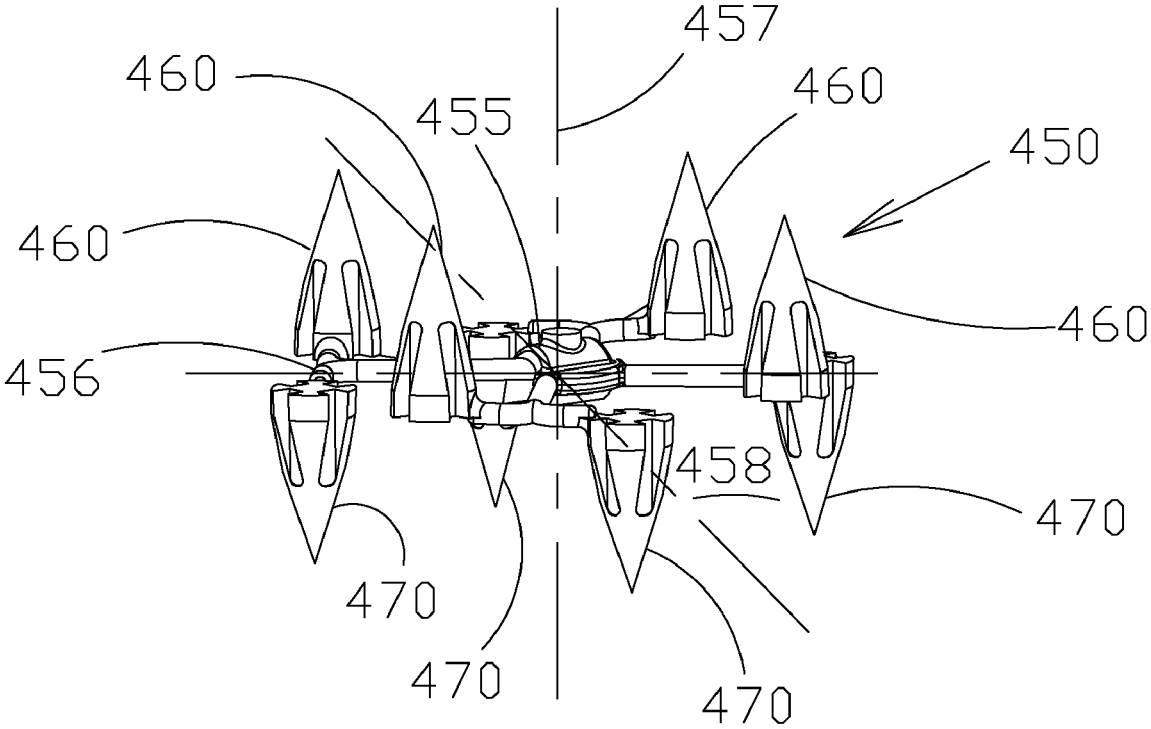
FIG. 24 is a close up perspective view of a preferred cluster.

Starting with FIGS. 7 and 8, it is seen that a spike 180 having a tip 181, a base 182 with an inside 183 and an outside 184, and having flutes 185 is provided. The base can fit over a male connector on an existing track, or alternatively act as a male connector that fits within a cup or hole in the track. The spike 180 is fully interchangeable with existing metal spikes. However, it is appreciated that spike 180 is preferably made of long fiber reinforced thermoplastic. In the preferred embodiment, the long fiber content by weight is approximately 10-70%. It is even more preferred that the long fiber content by weight be approximately 30-50%. However, it is understood that relative amounts outside of the preferred range may be used without departing from the broad aspects of the present invention. One preferred fiber is E-glass fibers. Another is carbon fiber. It is also understood that other fibers, such as natural fibers derived from plants and wood including lignin and cellulose, or other synthesized organic fibers such as polyester, non-organic such as synthetic carbon fiber or metallic such as stainless steel may be used without departing from the broad aspects of the present invention. It is preferred that the average fiber length is approximately 2-4 millimeters with a 25-30% Gaussian distribution around the average. Yet, it is understood that it may be possible to use fiber lengths that are shorter or longer without departing from the broad aspects of the present invention. Spikes formed with this reinforcement are strong enough to puncture or pierce tires, yet tough enough to resist shattering under the large amounts of force imparted upon the spike by an automobile tire.

Formation of the spikes 180 can be accomplished with any suitable process including injection, compression or injection-compression molding, or any other plastic-forming/shaping process. Raw materials can be provided as a prefabricated pellet of fiber embedded in resin, or alternatively can be provided separately for in-line mixing of resin and fiber.

Figure 1:
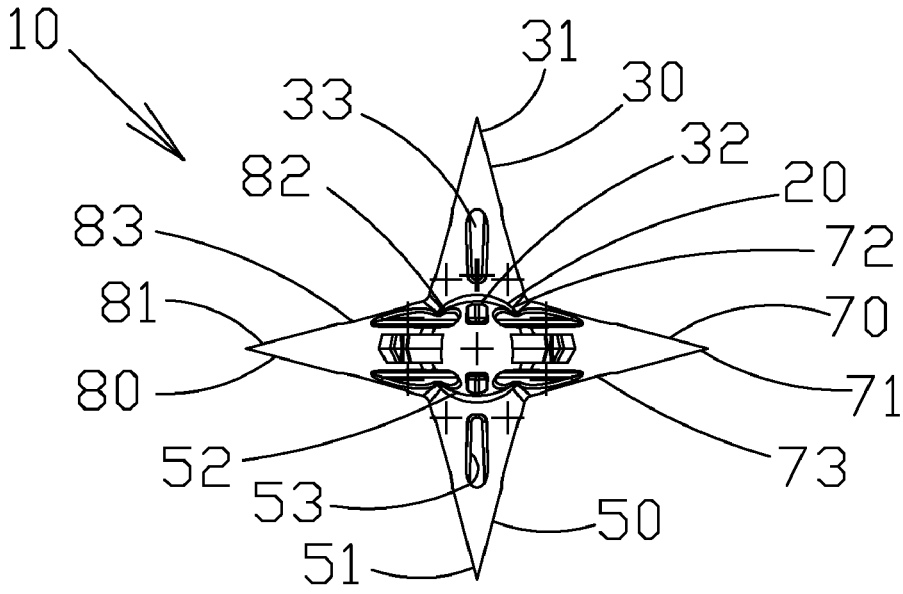
FIG. 1 is a top view of one preferred embodiment of the present invention.
Figure 2:
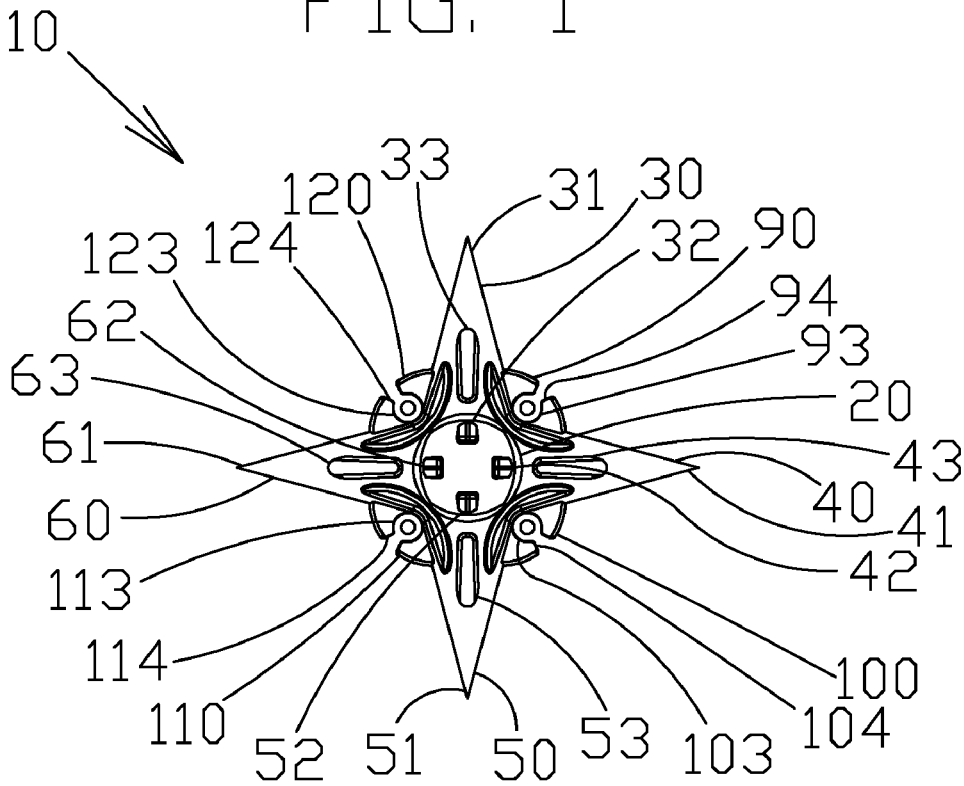
FIG. 2 is a side view of the preferred embodiment of the present invention illustrated in FIG. 1.
Figures 3, 4:
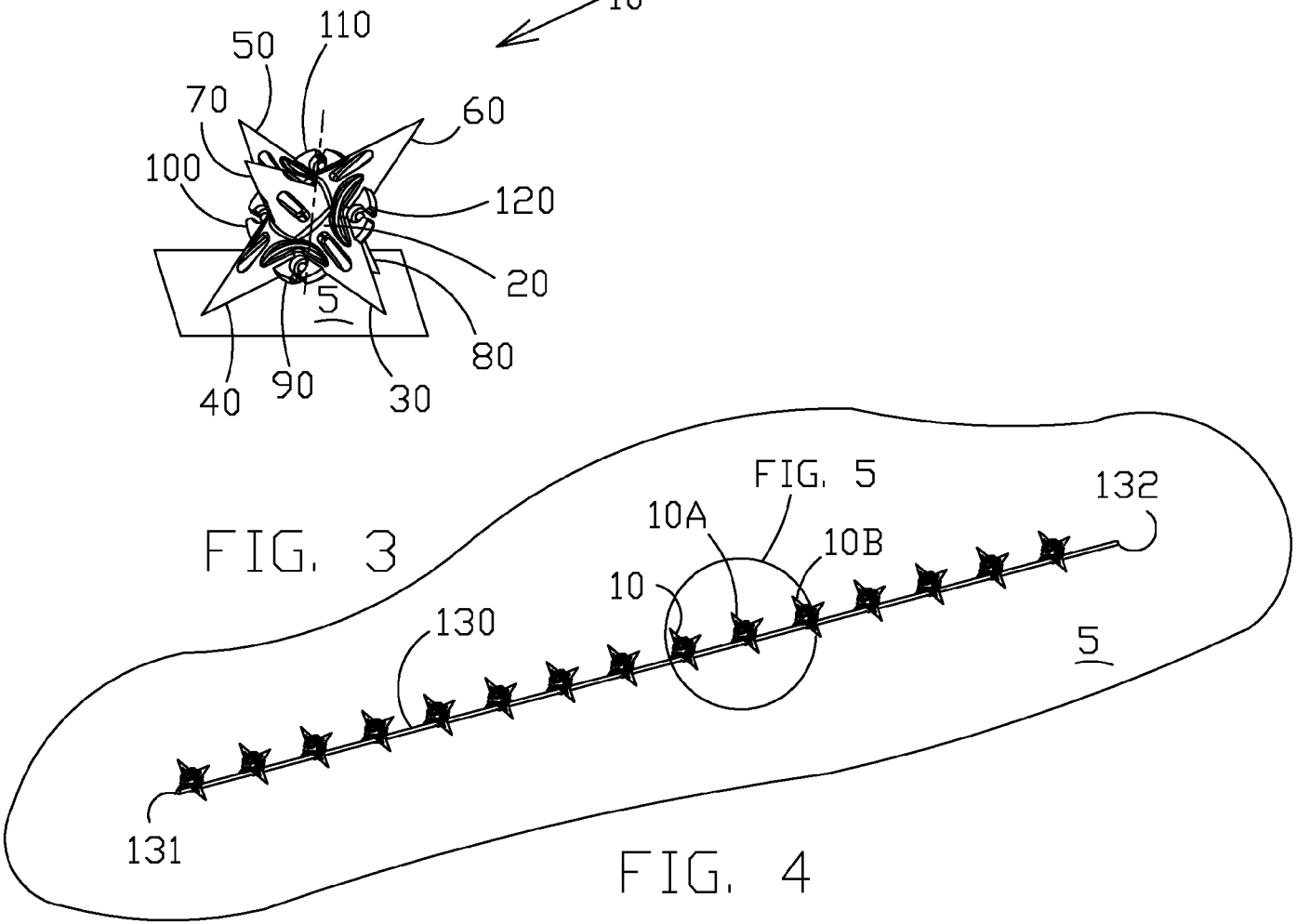
FIG. 3 is a perspective view of the preferred embodiment of the present invention illustrated in FIG. 1.
FIG. 4 is a perspective view showing several devices attached to a deployment string in a deployed position.

Turning now to FIGS. 1-3, it is seen that a preferred embodiment of a device 10 is illustrated. The device 10, when deployed on a surface 5, has a vertical axis 15. The device has a central hub 20. A plurality of piercing elements (described below) extends approximately 1.5 inches from the center of the hub 20. The device 10 is preferably made of long fiber reinforced thermoplastic. However, other materials can be used without departing from the broad aspects of the present invention.

Piercing element 30 has a point 31, a base 32 connected to the hub 20 side flutes 33. Piercing element 40 has a point 41, a base 42 connected to the hub 20 side flutes 43. Piercing element 50 has a point 51, a base 52 connected to the hub 20 side flutes 53. Piercing element 60 has a point 61, a base 62 connected to the hub 20 side flutes 63. Piercing element 70 has a point 71, a base 72 connected to the hub 20 side flutes 73. Piercing element 80 has a point 81, a base 82 connected to the hub 20 side flutes 83.

Each piercing element is preferably cone-shaped, and all of the piercing elements are preferably equally space about the hub 20. In this regard, with six piercing elements, each piercing element is spaced approximately 90 degrees from the four adjacent piercing elements, and is preferably collinear with the one opposite piercing element.

Four retainers 90, 100, 110 and 120 are further provided. Retainer 90 has a slot 91 and a neck 92. Retainer 100 has a slot 101 and a neck 102. Retainer 110 has a slot 111 and a neck 112. Retainer 120 has a slot 121 and a neck 122. The slots are preferably round in perimeter and are designed to receive a deployment string 130 (described below). The necks are preferably smaller than their respective slots, wherein a predetermined amount of force is necessary to force the string through the neck to remove the device from the string. Retainer 90 preferably spans between piercing elements 30 and 40. Retainer 100 preferably spans between piercing elements 40 and 50.

Retainer 110 preferably spans between piercing elements 50 and 60. Retainer 120 preferably spans between piercing elements 60 and 30. It is illustrated that all of the retainers lie in a single plane. However, it is understood that other retainer locations, configurations and/or numbers of retainers could be utilized without departing from the broad aspects of the present invention.

Figure 5:
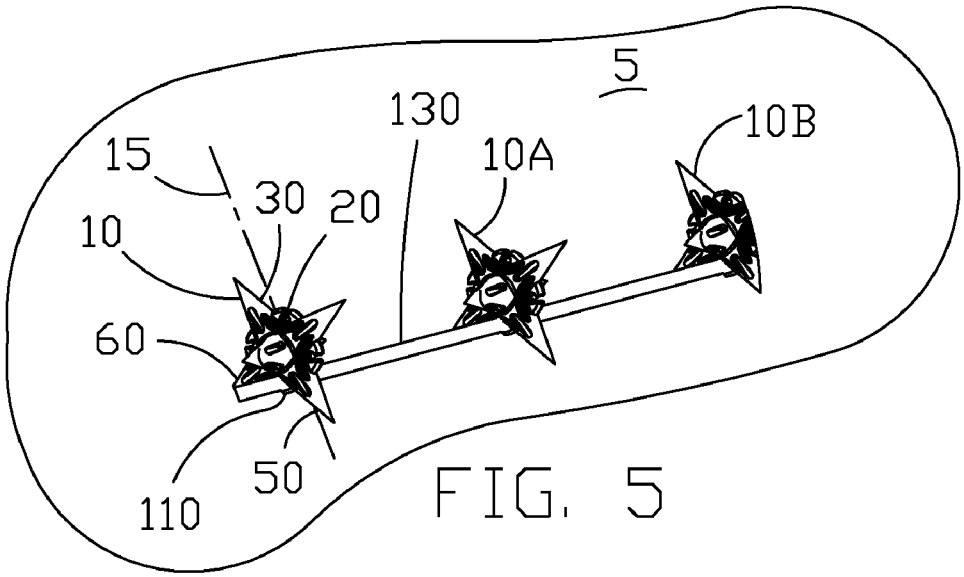
FIG. 5 is a close-up view of a portion of FIG. 4 as noted by circle-5.
Figure 6:
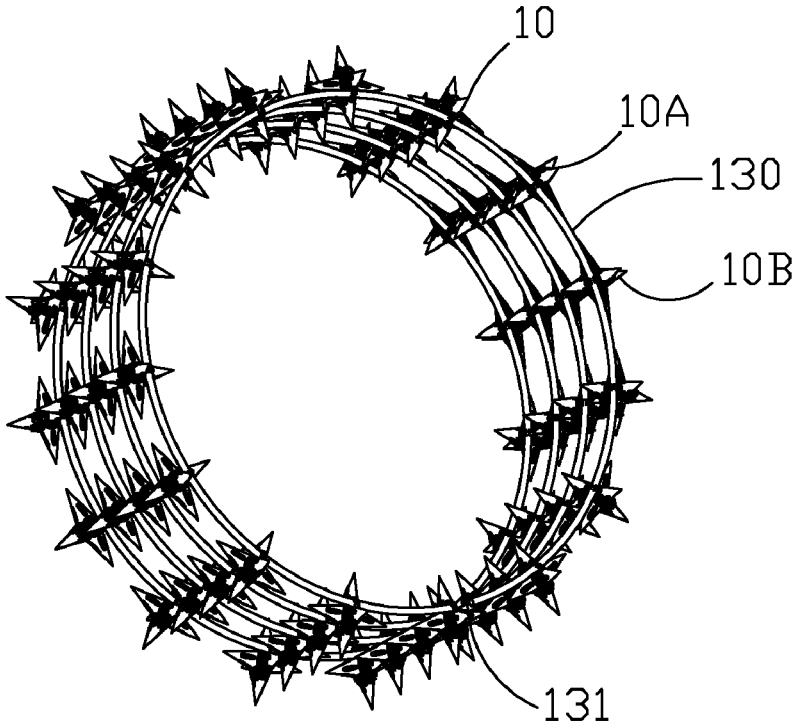
FIG. 6 is a perspective view showing many devices attached to a deployment string in a storage position.

Device 10 is designed for use on a deployment string and alternatively as a stand-alone tool. FIGS. 4-6 illustrate engagement of multiple devices 10, 10A and 10B on a deployment string. In particular, FIG. 4 illustrates several devices in the deployed position, and FIG. 6 illustrates the devices and deployment string in a storage position.

When deployed, three of the piercing elements contact a surface, roadway or ground. It is appreciated that any three adjacent elements can simultaneously contact the surface and in this regard the device is self-centering, self-balancing and self-leveling. The remaining three piercing elements supported in an upwardly projected orientation. It is preferred that the piercing elements project in a vertically divergent manner. It is also preferred that the three projecting elements are equidistant from each other about the vertical axis 15. In this regard, at least one piercing element will be angled generally towards the tire of an oncoming vehicle regardless of the rotational orientation of the device 10 about the vertical axis relative. It is understood that the devices 10 can be deployed from a moving vehicle, due to the self centering aspects of the present invention.

In the preferred embodiment, the device 10 detaches from the deployment string upon being impaled by the tire. However, the device could alternatively be designed such that the remainder of the string winds around the vehicle axis when one device impales the tire without departing from the broad aspects of the present invention.

Turning now to FIGS. 9-12, it is seen that an additional preferred embodiment of a device 210 is illustrated. The device 210, when deployed on a carrier strip 280, has a vertical axis 215. A base 220 is provided, as is a plurality of piercing elements 230, 240, 250, 260 and 270. The device 210 is preferably made of long fiber reinforced thermoplastic. However, other materials can be used without departing from the broad aspects of the present invention.

Base 220 has a cylindrical outside 221 and an interior shaft 222. A fastener 225, such as a pop rivet, can be used to secure the device 210 to a hole 283 between the ends 281 and 282 of a carrier strip 280. The cylindrical outside can alternative friction fit within a carrier strip hole without a separate fastener without departing from the broad aspects of the present invention.

Piercing element 230 has a point 231, a base 232 connected to the base 220 side flutes 233. Piercing element 240 has a point 241, a base 242 connected to the base 220 side flutes 243. Piercing element 250 has a point 251, a base 252 connected to the base 220 side flutes 253. Piercing element 260 has a point 261, a base 262 connected to the base 220 side flutes 263.

Piercing elements 230, 240, 250 and 260 are preferably vertically divergent from each other. Each element is preferably equidistantly spaced about the vertical axis 215 and is preferably oriented approximately 60 degrees from vertical. Yet, it is understood that other angles of vertical divergence, other numbers of piercing elements and/or variably spaced piercing elements may be utilized without departing from the broad aspects of the present invention.

Piercing element 270 has a point 271, a base 272 connected to the base 220 side flutes 273. Piercing element 270 is preferably vertically oriented on the device 210 and is connected to the base 220.

Each of the piercing elements preferably generally has a conical shape. However, other shapes could be used without departing from the broad aspects of the present invention.

A preferred embodiment of the carrier strip 280 is illustrated in FIGS. 13-16. The strip 280 is shown to have a generally rectangular perimeter, and is shown to be straight. However, other perimeter shapes and other orientations are within the scope of the present invention. The strip can be made of rigid or flexible materials, such as metal, leather, wood or any other suitable material. It is further appreciated that other types of carrier strips, such as accordion-style or other strips, may be utilized without departing from the broad aspects of the present invention.

Turning now to FIGS. 17-20, it is seen that another preferred embodiment is illustrated. In this embodiment, a device cluster 310 is provided. The cluster 310 has a hub 320, and a frame 330 comprising cross piece 331 and end pieces 332 and 333, respectively. The hub 320 is preferably centrally located within the frame 330.

A spike 340 having a vertically oriented piercing element 341 and a plurality of vertically divergent piercing elements 342 is provided. In this illustrated embodiment, four vertically divergent piercing elements are provided.

A spike 350 having a vertically oriented piercing element 351 and a plurality of vertically divergent piercing elements 352 is provided. In this illustrated embodiment, four vertically divergent piercing elements are provided.

A spike 360 having a vertically oriented piercing element 361 and a plurality of vertically divergent piercing elements 362 is provided. In this illustrated embodiment, four vertically divergent piercing elements are provided.

A spike 370 having a vertically oriented piercing element 371 and a plurality of vertically divergent piercing elements 372 is provided. In this illustrated embodiment, four vertically divergent piercing elements are provided.

Spikes 340, 350, 360 and 370 are preferably integrally connected to frame 330. This can be accomplished by forming the device cluster 310 in a multiple-cavity mold. The hub 320 can attach to a base in an existing carrier strip or device.

Turning now to FIGS. 21-24, it is seen that a further preferred embodiment of the device 410 is illustrated. Device 410 can be selectably folded for storage in a container 420, and straightened for deployment on a road or other surface.

In one embodiment, a gas canister 430 is provided for selectably inflating tube 440. One preferred gas is air. However, it is understood that many gasses could be used without departing from the broad aspects of the present invention. Tube 440 has ends 441 and 442. A plurality of folds 443 separate segments that are generally straight. The segments are generally parallel when the tube is in a deflated storage position. However, the inflation of the tube 440 causes the folds 443 to release and the tube 440 to straighten. The straightened length of the device is several times the length of the stored device.

A plurality of clusters 450 are preferably removably connected to tube 440. In the preferred embodiment, one cluster 450 is connected to the tube 440 in each segment. Clusters each have a central hub 455. A frame 456, preferably one that is rigid, extends away from the hub 455 in a plane 458 that lies generally perpendicular to a vertical axis 457 of the cluster.

The frame 456 supports preferably four upwardly oriented piercing elements 460, and also four downwardly oriented piercing elements 470. All the piercing elements preferably have a central axis that is parallel with the vertical axis 457 of the cluster 450. It is appreciated that more or fewer piercing elements 460 and 470 may be used without departing from the broad aspect of the present invention.

The clusters 450 are self centering. In this regard, there are always upwardly and downwardly oriented piercing elements regardless of whether the cluster is flipped or tipped on the deployment surface.

Figure 25:
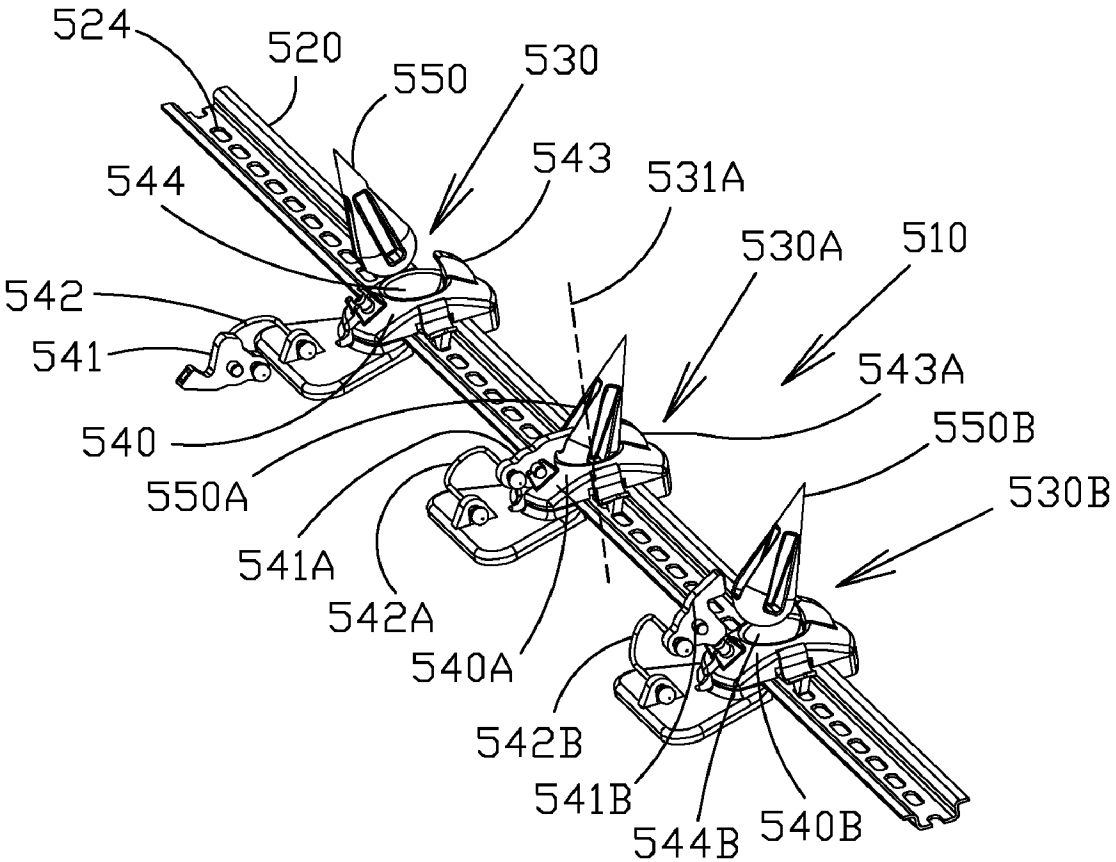
FIG. 25 is a perspective view of an alternative embodiment showing a trigger assembly connected to a rail.
Figure 26:
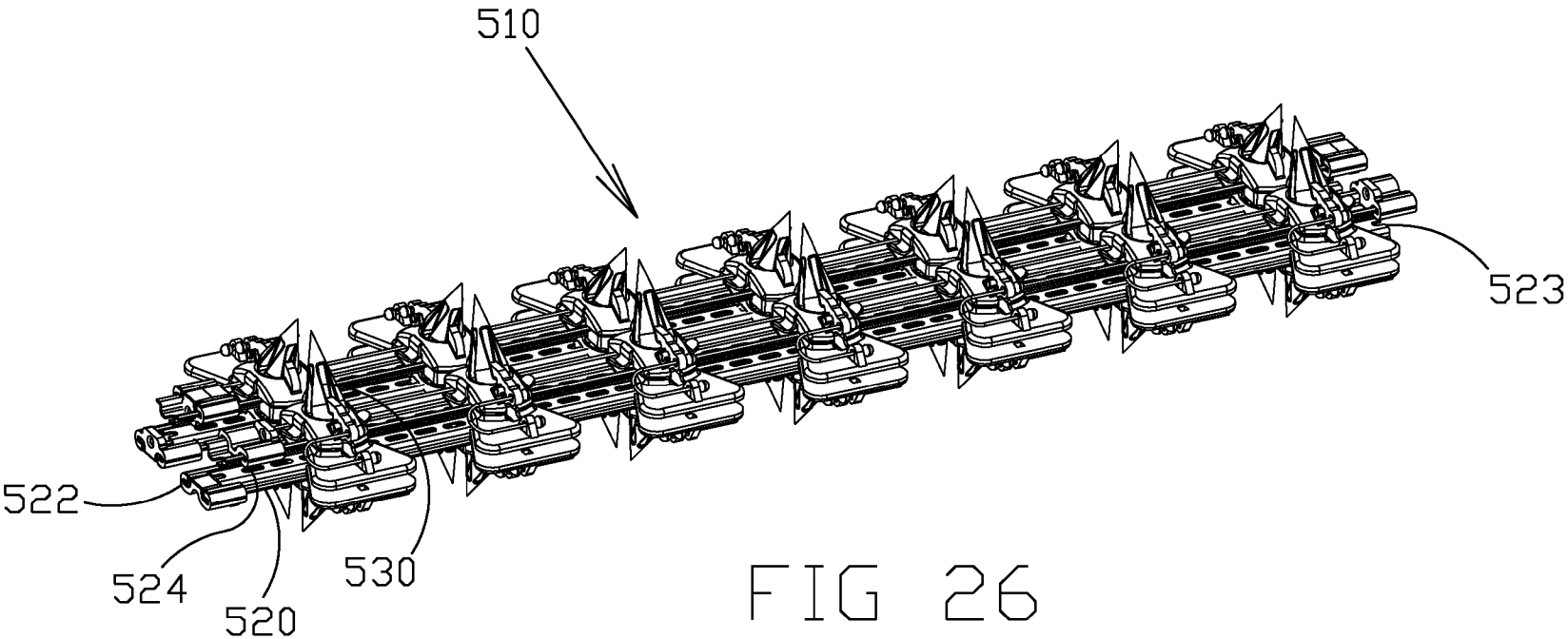
FIG. 26 is a perspective view of the alternative embodiment shown in FIG. 25 in a storage position.
Figure 27:
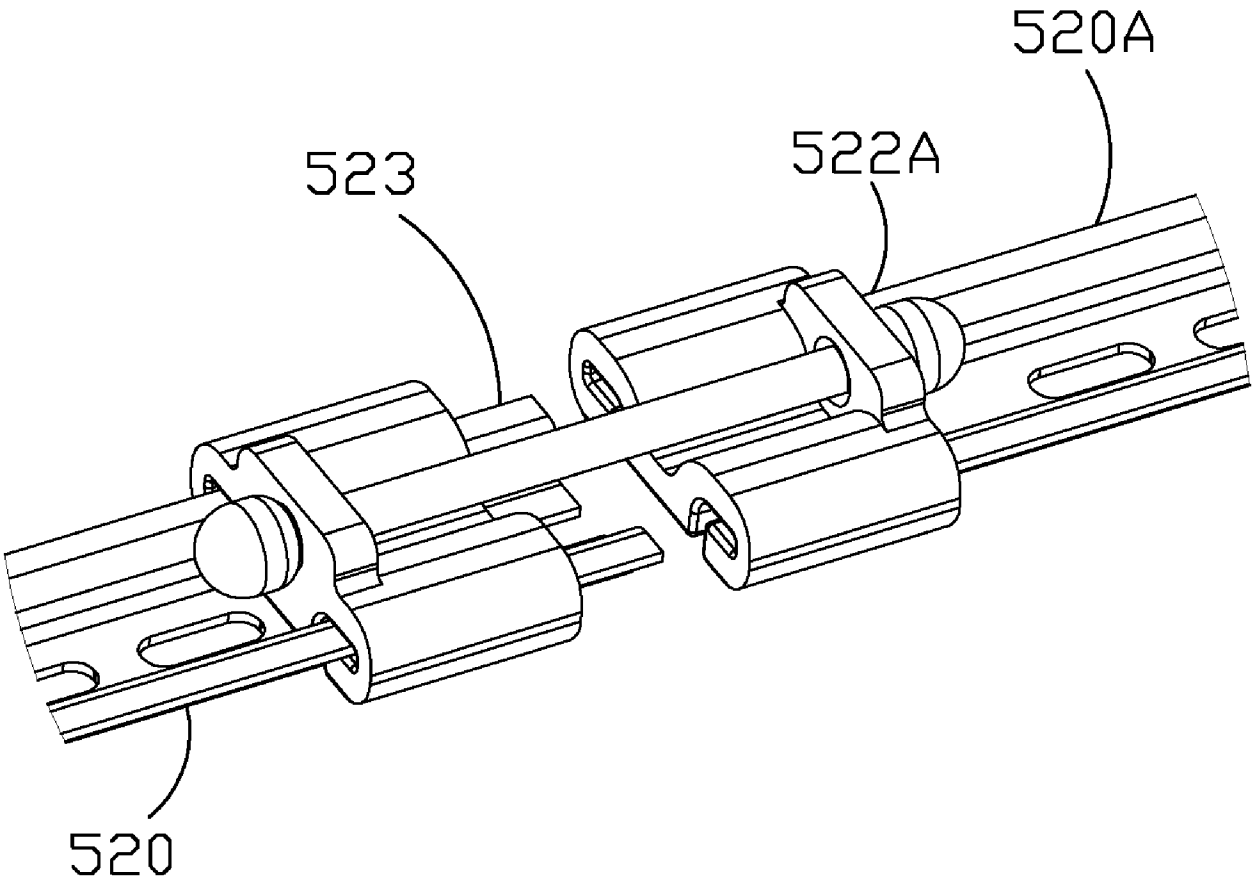
FIG. 27 is a close up perspective exploded view showing an end to end relationship of several rails.

Turning now to FIGS. 25-27, it is seen that a still further alternative embodiment of the present invention is illustrated. The device 510 is mountable on a rail 520. The rail 520 has ends 522 and 523. The first end of one rail is mountable with the second end of the adjacent rail. Two adjacent rails can be secured in an end-to-end (via quick connect pieces) arrangement with a segment of extendable chord. Each rail 520 has many holes or notches 524 formed through the rail along its longitudinal axis.

Trigger assemblies 530 are secured along the rail 520, having protrusions that extend through selected notches. Spacing of the trigger assemblies can vary widely. Each trigger assembly received a piercing element. Three configurations are shown in FIG. 25 (insertion, set, and removal).

Trigger assembly 530 has a vertical axis extending through the base 540. A support arm 541 and a latch 542 operate to secure the piercing element 550 within a hole 544 in the base. The support arm 541 engages a flute of the piercing element in order to secure the piercing element in place. A second support arm 543 is also provided for engaging the piercing element.

Insertion of piercing element 550B into trigger assembly hole 544B of base 540B of trigger assembly 530B is also shown in FIG. 25. The latch 542B and support arm 541B are shown ready to lock the piercing element 550B in place.

Piercing element 550A is locked in place within trigger assembly 530A. Support arm 541A and latch 542B are positioned so as to orient the end of support arm 541A in engagement with a fluted side of the piercing element. Arm 543A is also seen to be engaging piercing element 550A. It is seen that the vertical axis of the piercing element is preferably vertically divergent from the vertical axis 531A of the trigger assembly 530A when the piercing element is inserted into the trigger assembly.

Piercing element 550 is shown being released from the trigger assembly 530. This occurs when or after the piercing element 550 is impaled by a tire or the like.

Thus it is apparent that there has been provided, in accordance with the invention, road spikes with improved characteristics and methods of deployment that fully satisfies the objects, aims and advantages as set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. A road spike device having a tip and side flutes, and being constructed of a long fiber reinforced thermoplastic having approximately between 10-70% long fibers by weight said road spike device comprising:

a vertical axis;

a first piecing element vertically divergent from said vertical axis;

a second piercing element vertically divergent from said vertical axis;

a third piercing element vertically divergent from said vertical axis, and at least one retainer being removably connected to a deployment string and spanning between two of said first piercing element, said second piercing element and said third piercing element;

wherein said first piercing element, said second piercing element and said third piercing element are spaced apart in a vertically diver ent manner about said vertical axis a predetermined amount.

2. The road spike device of claim 1 further comprising:

a fourth piecing element;

a fifth piercing element; and a sixth piercing element, wherein:

each of said first piercing element, said second piercing element, said third piercing element, said fourth piercing element, said fifth piercing element and said sixth piercing element extend approximately the same distance from a center of said device;

said fourth piercing element, said fifth piercing element and said sixth piercing element contact a road surface to support the vertically divergent orientation of said first piercing element, said second piercing element and said third piercing element;

said at least one retainer is a first retainer spanning between said first piercing element and said second piercing element and said road spike device further comprises:

a second retainer spanning between said second piercing element and said third piercing element;

a third retainer spanning between said third piercing element and said fourth piercing element; and a fourth retainer spanning between said fourth piercing element and said first piercing element.

3. The road spike device of claim 1 further comprising:

a base, said base being removably connected to a carrier strip;

a fastener to hold said device to the carrier strip until said device is impaled by a tire, whereby said device is separated from the carrier strip; and a fourth piercing element vertically divergent from said vertical axis; and wherein each of said first piercing element, said second piercing element, said third piercing element and said fourth piercing element are spaced apart an equidistant amount about said vertical axis.

4. The road spike device of claim 1 comprising:

a first spike assembly, said first spike comprising said first piercing element, said second piercing element and said third piercing element;

a second spike assembly comprising a plurality of second spike piercing elements, said plurality of second spike piercing elements being vertically divergent;

a frame interconnecting said first spike and said second spike; and a hub.

5. The road spike device of claim 1 wherein said road spike device comprises a cluster having:

a plurality of vertically oriented piercing elements oriented in a first direction; and a plurality of vertically oriented piercing elements oriented in a second direction opposite of said first direction.

* * * * *